US005626531A

United States Patent [19]

Little

[11] Patent Number: 5,626,531

[45] Date of Patent: May 6, 1997

[54] GOLF BALL WITH TAG, AND DETECTING SYSTEM

[75] Inventor: Philip L. Little, Shanty Bay, Canada

[73] Assignee: Tee To Green Inc., Woodstock, Canada

[21] Appl. No.: 596,402

[22] Filed: Feb. 2, 1996

[51] Int. Cl.[6] ..... A63B 43/00

[52] U.S. Cl. ..... 473/353

[58] Field of Search ..... 473/353

[56] References Cited

U.S. PATENT DOCUMENTS

| | | | |
|---|---|---|---|
| 3,782,730 | 1/1974 | Horchler | 473/353 |
| 4,948,128 | 8/1990 | Emery et al. | 473/17 |
| 5,423,549 | 6/1995 | Englemeier | 473/353 |
| 5,447,314 | 9/1995 | Yamazaki et al. | 473/353 |

*Primary Examiner*—George J. Marlo
*Attorney, Agent, or Firm*—K. M. Garrett; D. W. Eggins

[57] ABSTRACT

Golf balls have a passive tag at selected capacitance inserted within their interior, to enable detection of the presence of the tag, and of the ball, using an electronic detecting system. The tags are passive, being energized into emitting a signal by the presence of a detector field of predetermined characteristics such that the tag generates a responsive signal, which can be detected by an adjacent detector circuit, to signal the presence of a tagged ball. One field of use is for driving ranges, where the unauthorized removal of range balls constitutes an unacceptable loss for the proprietors of the establishment. The system also lends itself to finding lost balls, using a hand-portable detector, and to use with other types of game ball.

13 Claims, 2 Drawing Sheets

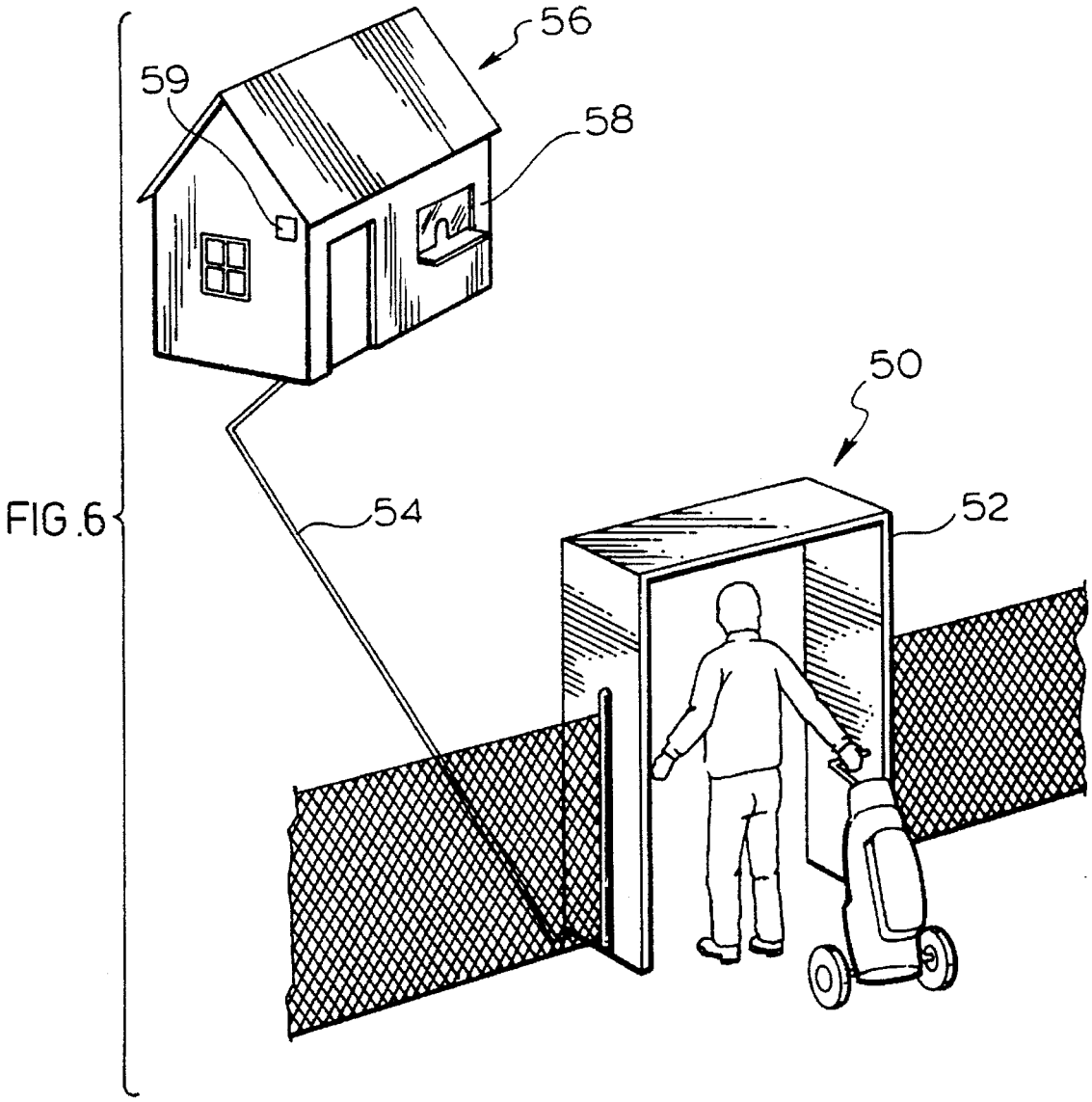
FIG. 6
FIG. 7.
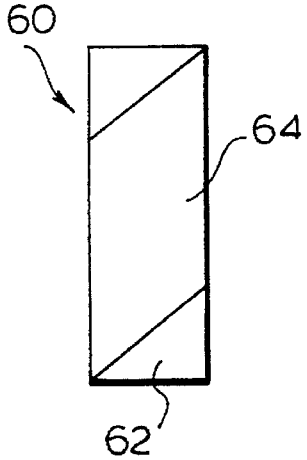
FIG. 8.
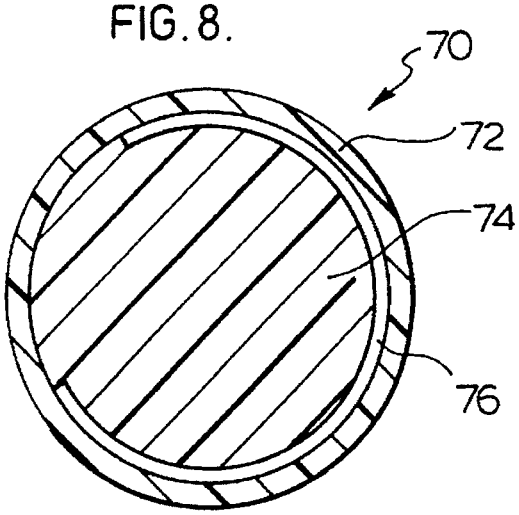

GOLF BALL WITH TAG, AND DETECTING SYSTEM

FIELD OF THE INVENTION

This invention is directed to a ball containing an electronic tag; to a golf ball incorporating the tag; and to a system for detecting the presence of electronically tagged golf balls.

BACKGROUND TO THE INVENTION

The loss of golfballs from driving ranges poses a severe financial strain on the proprietors of such facilities. The present practice of providing yellow balls for use by customers on golf driving ranges does not act as a sufficient deterrent to the unauthorized removal of the balls by some customers of the range.

Electronic tags have been widely used in merchandizing, to diminish or eliminate pilferage losses.

In most such prior art applications the tags are secured externally to the goods being protected, and customer egress from the area containing the goods is constrained, so as to cause all customers to pass through an electromagnetic monitoring field of predetermined frequency, to which the tag is tuned, and in response to which field the tag emits a detectable electronic signal. In use, the signal is detected, and then used to activate an alarm of one form or another.

A survey of the prior art has disclosed a range of applications of electronic tag technology, as disclosed in the following listed U.S. Pat. No. 4,727,360 Ferguson et al February 1988; U.S. Pat. No. 5,030,940 Siikarla July 1991; U.S. Pat. No. 5,030,941 Lizzi July 1991; U.S. Pat. No. 5,051,726 Copeland et al September 1991; U.S. Pat. No. 5,059,950 Perchak October 1991; U.S. Pat. No. 5,083,112 Piotrowski et al January 1992; U.S. Pat. No. 5,099,225 Narlow et al March 1992; U.S. Pat. No. 5,099,228 individual March 1992; U.S. Pat. No. 5,103,210 Checkpoint April 1992; U.S. Pat. No. 5,109,217 Siikarla et al April 1992; U.S. Pat. No. 5,121,106 Kataria et al June 1992; U.S. Pat. No. 5,151,684 . . . September 1992; U.S. Pat. No. 5,276,431 Piccoli et al January 1994; U.S. Pat. No. 5,327,118 Drucker et al July 1994; U.S. Pat. No. 5,353,011 Wheeler et al October 1994; U.S. Pat. No. 5,401,026 Eccher et al March 1995.

SUMMARY OF THE INVENTION

The present invention provides a ball having an outer cover; an inner core; and a transducer tag in close fitting relation sealed within the ball.

In one embodiment the transducer tag is encapsulated within the core.

In another embodiment the core contains at least one transducer tag; and at least one compensatory weight, to modulate the impact/flight characteristics of the ball. In a preferred embodiment the aforesaid ball is a golf ball.

In another embodiment the transducer tag is molded within the core portion of the ball.

The use of a wholly-molded, one-piece ball incorporating a tag therein is also contemplated.

Use of one form or other of a tag with a three-piece ball having an inner core, an outer core and a cover is another posibility.

In another embodiment the transducer tag is a force fit within an aperture in the ball, and sealed within the cover.

In a further embodiment the transducer tag may comprise at least two portions in mutually inclined relation, to provide enhanced sensitivity regardless of the orientation of the ball to the exciting field.

In a golf ball having a transducer tag permanently installed within the ball, the tag may have a resonant circuit of predetermined frequency response, to emit a detectable electronic signal when exposed to an electronic field of predetermined strength and having a predetermined frequency range.

A further suitable type of tag, previously used in electronic article surveillance comprises a pair of dissimilar, planar capacitors in physically sandwiched relation. The planar form of these capacitors may be modified to a rolled, cylindrical form, to reduce their lateral dimension In combination with a golf ball having a transducer tag permanently sealed therein, the tag having a resonant circuit to provide a detectable electronic signal output when exposed to an electronic detector field having predetermined characteristics of range of frequency, and field strength; a magnetic field generator to generate the predetermined field, and a signal detector coupled with an alarm, the detector being responsive, in use, to the aforesaid tag signal output, to activate the alarm. In another embodiment the outer casing of the golf ball may be marked externally with a symbol indicating a preferred orientation of the ball to the intended direction of flight, i.e. in relation to the axis of impact of the club, in recognition of the changed coefficient of restitution of the ball, so as to optimize the dynamic energy transfer characteristics of the ball when struck by a club.

One such marking may be in the form of a so-called "sweet-spot" or club impact target area.

The orientation marking of the ball may also be influenced by considerations of minimizing the vulnerability of the tag to repeated driving impacts that are associated with its use on a driving range.

BRIEF DESCRIPTION OF THE DRAWINGS

Certain embodiments of the invention are described, by way of illustration, without limitation of the invention thereto other than as set forth in the accompanying claims, reference being made to the accompanying drawings, wherein:

FIG. 6 is a schematic representation of a detector installation in accordance with the invention;

FIG. 7 is a sketch plan of a further form of tag; and,

FIG. 8 is a diametrical section of a further golfball embodiment of the invention.

DETAILED DESCRIPTION OF THE INVENTION

Figure 1:
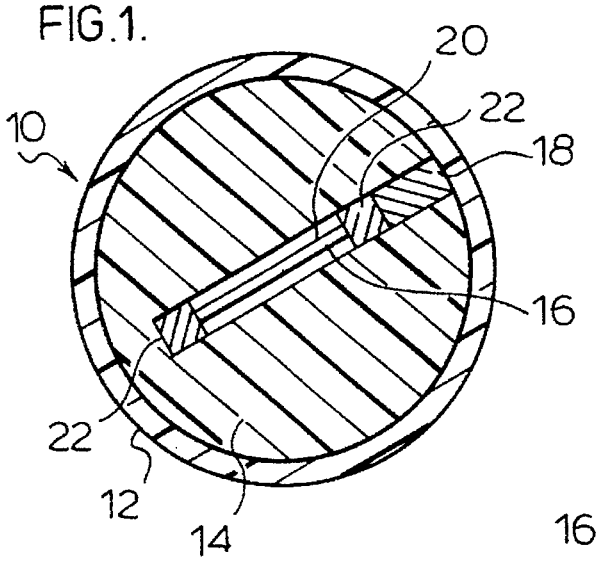
FIG. 1 is a diametrical section of a ball containing a transducer tag, in accordance with the present invention.

Referring to FIG. 1, a golfball 10 has a cover portion 12 and a core portion 14 in sealed relation therein.

An aperture 16 contains an electronic transducer tag 20, located therein.

The ball core may comprise a molded outer core portion and a molded inner core portion.

The aperture 16 is shown having compensatory plugs 22 therein, by which the mass characteristics of the transducer tag and its associated aperture 16 may be at least partially compensated.

A filler plug 18 is illustrated.

The cover portion 12 of the ball 10 is sealed, preferably by way of being, ab initio, a one piece molding, so as to resist the penetration of moisture to the tag 20, and to maintain the integrity of the ball in its primary role. It is contemplated that the tag 20 may be retrofitted to a ball, such that the aperture 16 may be provided subsequently to the molding of the cover 12.

In this case, subsequent to the installation of the tag 20 the cover 12 is re-sealed.

Figure 2:
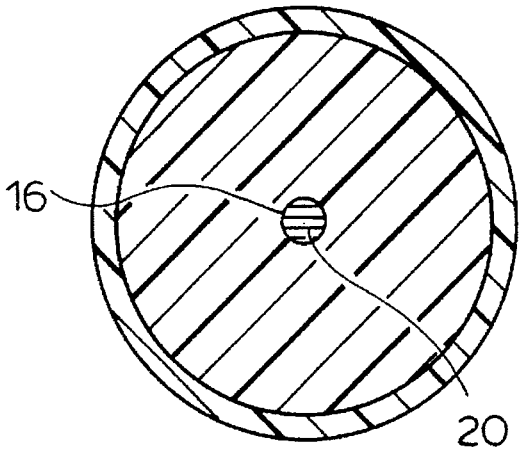
FIG. 2 is a (full) section view at 2—2 of FIG. 1.
Figure 3:
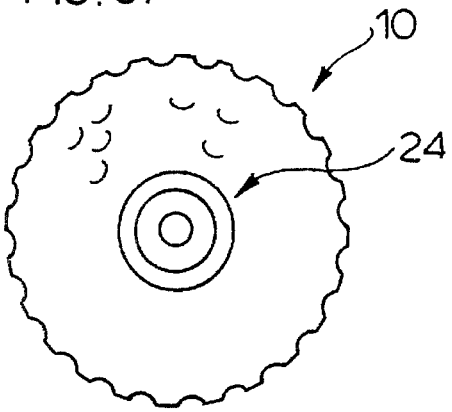
FIG. 3 is an embodiment of the present invention having a representation of a "sweet-spot" on the cover of the ball.
Figure 4:
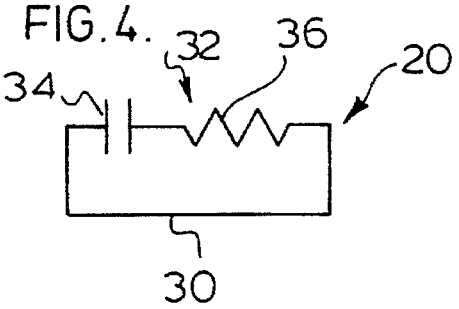
FIG. 4 is a schematic circuit diagram of a transducer tag embodiment.

Referring to FIG. 2, it will be seen that the transducer 20 is a snug fit within the aperture 16. FIG. 3 shows a golfball 10 having a "sweet-spot" 24 molded on the outer cover 12. A portion only of the dimples on the ball cover are shown. The location of this cover marking has regard both to the impact and "carrying" characteristics of the ball when struck and also to the most structurally favourable and least destructive impact zone in relation to the transistor 20. Turning to FIG. 4, a transducer tag 20 is shown having an aerial portion 30 with a resonant circuit 32 comprising capacitor 34 and impedance 36.

A certain extent of capacitive linking interaction with the inherent capacitance of the ball structure may be compensated for in selecting the values of capacitor 34 and impedence 36, in order to achieve the desired frequency response range.

Figure 5:
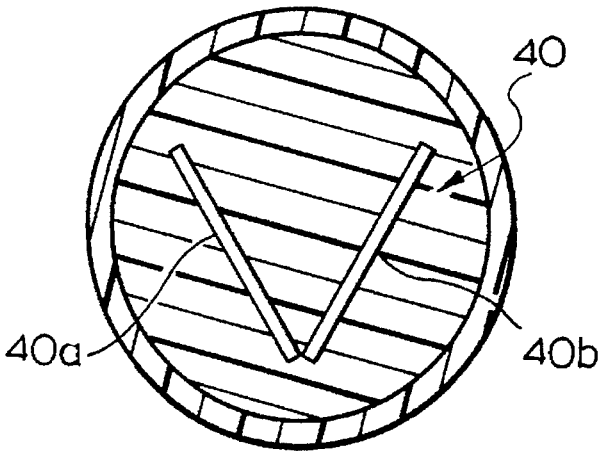
FIG. 5 is a view similar to FIG. 1, showing a further ball embodiment.

FIG. 5 shows an embodiment having an angled capacitor arrangement 40, illustrated as being molded within a solid core. The use of compensatory-mass plugs may be dispensed with. The arrangement 40 is shown as comprising two separate capacitors 40*a* and 40*b*.

Referring to FIG. 6, a controlled exit 50 comprises a detector gate 52 linked by an underground power line and a signal line, both represented by chain dotted line 54, connecting with hut 56.

The hut 56 is shown having a pay wicket 58 and accomodates staff of the establishment.

It will be understood that the detector gate 52 may comprise an entrance or an exit to the hut 56, or other building, so as to form a portion of the route of a user who is leaving the facility.

The hut 56 may contain an audible warning device 59, illustrated as being located outside the hut 56. The audible warning device 59 is connected to the ball detection circuit of the gate 52.

FIG. 7 shows a form of tag 60, comprising a wafer having a first rectangular capacitor 62, and an overlying parallellapiped capacitor 64.

It is contemplated that in one embodiment tags of this wafer form may be rolled, semi-cylindrically.

In a further embodiment the wafer tag may be wrapped, or partially wrapped about the periphery of an inner or of an outer core of a ball. FIG. 8 shows such a ball arrangement 70 having an outer cover 72 enclosing a core 74 with a capacitor wafer tag 76 wrapped about the core 74, as referred to above.

Use of the subject invention with golfballs, upon a golf course is contemplated, wherein the requisite electromagnetic field generator may be mounted upon a vehicle such as a golf cart, while persons with directional, hand-held response detectors can locate balls lost in the rough, etc.

It is contemplated that the subject invention may include a tag permanantly located in sealed relation within other forms of ball, such as baseballs, for purposes, in use, to enable the establishment of undisputed ownership thereof.

COMMERCIAL UTILIZATION

Widespread adoption of this invention on the North American continent is anticipated, as a counter to loss of balls, by theft.

What I claim by letters patent of the United States is:

1. A golf ball having an inner portion, a passive, filed-responsive electronic signalling tag including at least one capacitor positioned within the ball and having a predetermined response frequency, to generate a signal output of predetermined frequency range in response to the presence of an electromagnetic field having predetermined frequency and field strength characteristics; and an outer cover in sealing relation with said inner portion and said passive tag.

2. The ball as set forth in claim 1, said ball having a core, with said passive, field-responsive tag being sealed in the ball.

3. The ball as set forth in claim 2, including compensatory weight means within said core, to substantially compensate the mass of said ball core for the reduction in weight thereof due to the location of said transducer tag therein.

4. The ball as set forth in claim 2, said ball having said tag molded therein.

5. The ball as set forth in claim 4, said tag having two portions thereof in mutually inclined relation.

6. The ball as set forth in claim 1, said tag comprising a pair of capacitors having different capacitances.

7. The ball as set forth in claim 1, in combination with electromagnetic field generating means for generating a field within a predetermined frequency range, wherein said tag is responsive to said field, in use to emit a detectible signal in response to the field.

8. The ball and field generating means combination as set forth in claim 7, wherein said field generating means is concealed within a detector gate, said detector gate comprising the access to a fenced off area wherein said ball is normally contained.

9. The ball and field generating means combination as set forth in claim 8, including response-signal receiving means, in use to receive signals emitted by said ball in response to said field.

10. The ball and field generating means combination as set forth in claim 8, including response-signal receiving means, in use to receive signals emitted by said ball in response to said field; and warning signal emitting means controlled by said response-signal receiving means, to give a perceptible warning of the presence of said ball.

11. The ball and field generating means combination as set forth in claim 7, including response-signal receiving means, in use to receive signals emitted by said ball in response to said field.

12. The ball and field generating means combination as set forth in claim 7, including response-signal receiving means, in use to receive signals emitted by said ball in response to said field; and warning signal emitting means controlled by said response-signal receiving means, to give a perceptible warning of the presence of said ball.

13. The ball as set forth in claim 1, said passive, field-responsive tag comprising a wafer capacitor located within said cover, in wrapped relation about an inner core portion of said ball.

* * * * *